US005935913A

United States Patent [19]

Nalesnik et al.

[11] Patent Number: 5,935,913

[45] Date of Patent: Aug. 10, 1999

[54] CYCLIC THIOUREA ADDITIVES FOR LUBRICANTS

[75] Inventors: Theodore T. Nalesnik, Hopewell Junction; Cyril A. Migdal, Pleasant Valley, both of N.Y.

[73] Assignee: Uniroyal Chemical Company, Inc., Middlebury, Conn.

[21] Appl. No.: 09/173,888

[22] Filed: Oct. 16, 1998

[51] Int. Cl.[6] ..... C10M 135/16

[52] U.S. Cl. ..... 508/255; 508/284

[58] Field of Search ..... 508/255, 284

[56] References Cited

U.S. PATENT DOCUMENTS

| | | | |
|---|---|---|---|
| 2,767,143 | 10/1956 | Caffrey, Jr. et al. | 508/284 |
| 2,868,727 | 1/1959 | Hughes | 508/284 |
| 3,108,071 | 10/1963 | Harker | 508/284 |
| 3,218,258 | 11/1965 | Bauer et al. | 508/255 |
| 3,404,090 | 10/1968 | Betty et al. | 508/255 |
| 3,459,664 | 8/1969 | Anderson | 508/255 |
| 4,329,239 | 5/1982 | Chou | 508/255 |
| 5,084,195 | 1/1992 | Camenzind et al. | 252/47.5 |
| 5,300,243 | 4/1994 | Camenzind et al. | 252/47.5 |
| 5,498,809 | 3/1996 | Emert et al. | 585/13 |
| 5,512,190 | 4/1996 | Anderson et al. | 252/47 |
| 5,514,189 | 5/1996 | Farng et al. | 44/383 |

OTHER PUBLICATIONS

Smalheer et al, "Lubricant Additives", pp. 1–11, Jan. 1967.

*Primary Examiner*—Ellen M. McAvoy
*Attorney, Agent, or Firm*—Raymond D. Thompson

[57] ABSTRACT

Disclosed herein is a composition comprising:

(A) a lubricant, and (B) at least one cyclic thiourea selected from the group consisting of:

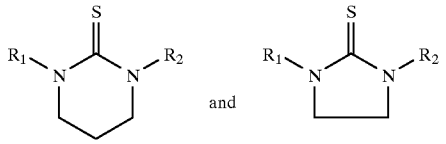

wherein $R_1$ and $R_2$ are independently selected from the group consisting of alkyl, functionalized alkyl, and hydrogen.

14 Claims, No Drawings

CYCLIC THIOUREA ADDITIVES FOR LUBRICANTS

BACKGROUND OF THE INVENTION

1. Field of the Invention

This invention is related to lubricating oils and, more particularly, to a class of ashless and nonphosphorus-containing antiwear, antifatigue, and extreme pressure additives derived from cyclic thioureas.

2. Description of Related Art

In developing lubricating oils, there have been many attempts to provide additives that impart antifatigue, antiwear, and extreme pressure properties thereto. Zinc dialkyldithiophosphates (ZDDP) have been used in formulated oils as antiwear additives for more than 50 years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the antiwear properties of the lubricating oil.

In view of the aforementioned shortcomings of the known zinc and phosphorus-containing additives, efforts have been made to provide lubricating oil additives that contain neither zinc nor phosphorus.

Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides antiwear properties to a lubricating oil. The additive is the reaction product of 2,5-dimercapto-1,3,4-thiadiazole and a mixture of unsaturated mono-, di-, and triglycerides. Also disclosed is a lubricating oil additive with antiwear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective antiwear/antioxidant additives for lubricants and fuels.

U.S. Pat. Nos. 5,084,195 and 5,300,243 disclose N-acyl-thiourethane thioureas as antiwear additives specified for lubricants or hydraulic fluids.

U.S. Pat. No. 5,498,809 discloses oil soluble copolymers derived from ethylene and 1-butene that have a number average molecular weight between about 1,500 and 7,500, at least about 30 percent of all polymer chains terminated with ethylvinylidene groups, and an ethylene-derived content of not greater than about 50 weight percent, and which form solutions in mineral oil free of polymer aggregates, as determined by light scattering measurements. Lubricating oil additives, particularly dispersants, produced by the functionalization and derivatization of the these copolymers are said to have enhanced performance (e.g., improved dispersancy and pour point) in lubricating oil compositions, attributable in part to the combination of properties characterizing the copolymers.

The disclosures of the foregoing references are incorporated herein by reference in their entirety.

SUMMARY OF THE INVENTION

The present invention relates to substituted cyclic thiourea compounds of the formulas

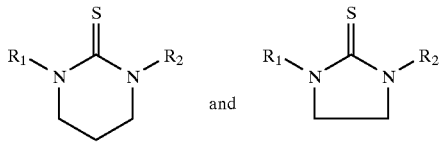

wherein $R_1$ and $R_2$ are independently selected from the group consisting of alkyl, functionalized alkyl, and hydrogen.

In the above structural formulas, $R_1$ and/or $R_2$ can be a straight or branched chain, fully saturated or partially unsaturated, alkyl moiety, preferably having from 1 to 40 carbon atoms, e.g., methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof. Additionally, $R_1$ and/or $R_2$ can be a straight or branched chain, a fully saturated or partially unsaturated hydrocarbon chain, preferably having from 1 to 40 carbon atoms, within which may be ester groups or heteroatoms, such as oxygen and sulfur, which may take the form of ethers, polyethers, and sulfides. This is what is meant by "functionalized alkyl."

The cyclic thiourea compounds of this invention are useful as ashless, non-phosphorus-containing antifatigue, antiwear, extreme pressure additives for lubricating oils.

The present invention also relates to lubricating oil compositions comprising a lubricating oil and a functional property-improving amount of at least one cyclic thiourea compound of the above formulas. More particularly, the present invention is directed to a composition comprising:

(A) a lubricant, and (B) at least one cyclic thiourea selected from the group consisting of:

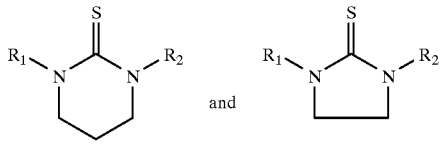

wherein $R_1$ and $R_2$ are independently selected from the group consisting of alkyl, functionalized alkyl, and hydrogen.

DESCRIPTION OF THE PREFERRED EMBODIMENTS

The cyclic thiourea compounds of the present invention are selected from the group consisting of compounds of the formulas

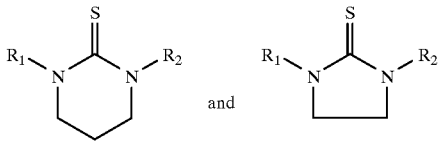

wherein $R_1$ and $R_2$ are independently selected from the group consisting of alkyl, functionalized alkyl, and hydrogen.

In the above structural formula, $R_1$ and/or $R_2$ can be an alkyl moiety, preferably of 1 to 40 carbon atoms, more preferably of 12 to 18 carbon atoms, and can have either a straight chain or a branched chain, a fully saturated or partially unsaturated hydrocarbon chain, e.g. methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers, e.g., 2-ethylhexyl, and mixtures thereof. $R_1$ and/or $R_2$ can have from 1 to 40 carbon atoms, preferably 12 to 18 carbon atoms, and can be either a straight chain or a branched chain, a fully saturated or partially unsaturated hydrocarbon chain, wherein said chains may contain ester groups or heteroatoms, such as oxygen and/or sulfur, which may take the form of ethers, polyethers, sulfides, and the like. As employed herein, the term "alkyl" is also intended to include "cycloalkyl." Where the alkyl is cyclic, it preferably contains from 3 to 9 carbon atoms, e.g., cyclopropyl, cyclobutyl, cyclopentyl, cyclohexyl, cycloheptyl, cyclooctyl, cyclononyl, and the like. Cycloalkyl moieties having 5 or 6 carbon atoms, i.e., cyclopentyl or cyclohexyl, are more preferred.

As noted above, $R_1$ and/or $R_2$ can also be hydrogen; it is preferred, however, that no more than one of $R_1$ or $R_2$ be hydrogen. In other words, it is preferred that at least one of the nitrogen atoms of the cyclic thioureas of the present invention have an alkyl or functionalized alkyl substituent, as defined herein, attached thereto.

The following diamines are examples of those that can be used to react with carbon disulfide to form the cyclic thioureas of the present invention:

Octyl/decyloxypropyl- 1,3 -diaminopropane (D)A- 1214, Tomah Inc.);

Isodecyloxypropyl-1,3-diaminopropane (DA-14, Tomah Products Inc.);

Isododecyloxypropyl- 1,3-diaminopropane (DA- 16, Tomah Products Inc.);

Dodecyl/tetradecyloxypropyl- 1,3 -diaminopropane (DA-1618, Tomah Products Inc.);

Isotridecyloxypropyl-1,3-diaminopropane (DA-17, Tomah Products Inc.);

Tetradecyloxypropyl- 1,3-diaminopropane (DA- 18, Tomah Products Inc.);

N-coco-1,3-diaminopropanes (Duomeen C, Akzo Nobel Chemicals Inc.);

N-tallow-1,3-diaminopropanes (Duomeen T, Akzo Nobel Chemicals Inc.);

N-oleyl-1,3-diaminopropane (Duomeen O, Akzo Nobel Chemicals Inc.); and the like.

The use of the cyclic thiourea compounds of this invention can improve the antifatigue, antiwear, and extreme pressure properties of a lubricant.

General Synthesis of Additives of this Invention

The synthesis of the cyclic thiourea compounds of the present invention can be carried out by the reaction of 1,2-ethylene or 1,3-propylene diamines with carbon disulfide to form a thiocarbamate ammonium intermediate, which then cyclizes to the product with gaseous hydrogen sulfide as the by-product. Those skilled in the art will recognize that if the starting material is a 1,2-ethylene diamine, the resulting product will be the above-shown five-membered ring, whereas if the starting material is a 1,3-propylene diamine, the resulting product will be the above-shown six-membered ring.

A variety of solvents can be used in this reaction, provided that they are inert toward carbon disulfide under the reaction conditions. Such solvents may be secondary alcohols, e.g., isopropyl alcohol and sec-butyl alcohol; linear, branched, or cyclic hydrocarbons, e.g., hexane, heptane, cyclohexane and mixtures thereof; aromatic or alkylaromatic solvents, e.g., benzene, toluene, xylenes, or tetralins; or petroleum mineral oils or synthetic oils, e.g., poly α-olefins or polyol ester oils. The reaction process may require a single solvent or a mixture of solvents, of which one or all may be removed from the cyclic thiourea product or may remain therewith as part of the product's commercial composition. The final product may be isolated neat or diluted in a solvent.

The reaction is carried out by the slow addition of carbon disulfide to the diamine in an appropriate solvent under an inert atmosphere, e.g., nitrogen, forming first the thiocarbamide ammonium salt intermediate. The reaction is very exothermic and its temperature should be kept below about 40° C., preferably between about 20° and 30° C., by cooling means such as, for example, a cooling jacket, coils, or an ice-bath, to minimize the vaporization of carbon disulfide and its consequent loss. Higher temperatures can be maintained, if desired, if the reactor is sealed and/or kept under pressure.

After the carbon disulfide addition is complete, the temperature is slowly raised to about 140° to 160° C. At about 70° to 85° C., the thiocarbamide ammonium salt cyclizes to the cyclic thiourea product releasing the by-product, hydrogen sulfide. Nitrogen is sparged through and/or above the reaction media to remove the hydrogen sulfide gas more efficiently, while the temperature is held between about 70° to 85° C. The hydrogen sulfide is collected in a caustic trap, and when its evolution has ceased or minimized the reaction media temperature is raised to about 100° C. At this temperature, any low boiling or volatile solvents, such as isopropyl alcohol, are distilled off. The temperature is then increased to about 140° to 160° C. for about one to five hours, while the reaction media are sparged with nitrogen to ensure that the reaction goes to completion. The reaction is then cooled to room temperature, whereupon the product may solidify. If it is desired to depress the melting point of the product closer to room temperature, a high boiling alcohol, such as, 2-ethylhexanol, may be added at a concentration of about one to about five weight percent. The reaction product is then warmed to the liquid state and polish filtered.

If there is a need to ensure the nonexistence of ammonium sulfides in the product, the product can be washed with a caustic solution neat or prediluted with a solvent or solvent mixture, such as heptane and isopropyl alcohol. The product can then be dried by use of drying agents, such as magnesium sulfate, or by vacuum stripping.

Use with Other Additives

The cyclic thiourea additives of this invention can be used as either a partial or complete replacement for the zinc dialkyldithiophosphates currently used. They can also be used in combination with other additives typically found in lubricating oils, as well as with other ashless, antiwear additives. The additives typically found in lubricating oils are, for example, dispersants, detergents, corrosion/rust inhibitors, antioxidants, antiwear agents, antifoamants, friction modifiers, seal swell agents, demulsifiers, VI improvers, pour point depressants, and the like. See, for example, U.S. Pat. No. 5,498,809 for a description of useful lubricating oil composition additives, the disclosure of which is incorporated herein by reference in its entirety. Examples of dispersants include polyisobutylene succinimides, polyisobutylene succinate esters, Mannich Base ashless dispersants, and the like. Examples of detergents include metallic phenates, metallic sulfonates, metallic salicylates, and the like. Examples of antioxidants include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of antiwear additives that can be used in combination with the additives of the present invention include organo borates, organo phosphites, organic sulfur-containing compounds, zinc dialkyldithiophosphates, zinc diaryldithiophosphates, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others. Examples of friction modifiers include fatty acid esters and amides, organo molybdenum compounds, molybdenum dialkylthiocarbamates, molybdenum dialkyl dithiophosphates, and the like. An example of an antifoamant is polysiloxane, and the like. An example of a rust inhibitor is a polyoxyalkylene polyol, and the like. Examples of VI improvers include olefin copolymers and dispersant olefin copolymers, and the like. An example of a pour point depressant is polymethacrylate, and the like.

Lubricant Compositions

Compositions, when they contain these additives, are typically blended into the base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergent/Rust Inhibitor | 0.01–6 | 0.01–3 |
| Pour Point Depressant | 0.01–1.5 | 0.01–0.5 |
| Antifoaming Agent | 0.00–0.1 | 0.001–0.01 |
| Antiwear Agent | 0.001–5 | 0.001–1.5 |
| Seal Swellant | 0.1–8 | 0.1 |
| Friction Modifier | 0.01–3 | 0.01–1.5 |
| Lubricating Base Oil | Balance | Balance |

When other additives are employed, it may be desirable, although not necessary, to prepare additive concentrates comprising concentrated solutions or dispersions of the subject additives of this invention, together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and/or by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocrackate base stocks produced by hydrocracking (rather than solvent extracting) the aromatic and polar components of the crude. Natural lubricating oils include animal oils, vegetable oils (e.g., rapeseed oils, castor oils, and lard oil), petroleum oils, mineral oils, and oils derived from coal or shale.

Synthetic oils include hydrocarbon oils and halo-substituted hydrocarbon oils, such as, polymerized and interpolymerized olefins, alkylbenzenes, polyphenyls, alkylated diphenyl ethers, alkylated diphenyl ethers, alkylated diphenyl sulfides, as well as their derivatives, analogs, homologues, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLE 1

(100 wt % active)

Into a one-liter flask blanketed with nitrogen are charged 300 mL of o-xylene and 50 grams (0.20 mole) of Akzo's Duomeen C (N-coco-1,3-propylenediamine). To this is added, with stirring and external cooling, 17 grams (0.22 mole) of carbon disulfide in 70 mL of o-xylene at a rate such that the exothermic reaction does not exceed 30° C. The temperature is then slowly raised to 120° C. with the evolution of hydrogen sulfide, which is caught in a caustic trap under a nitrogen purge. The temperature is maintained at 120° C. for five hours, yielding a clear yellow liquid. At room temperature, the reaction media are washed with 75 mL of aqueous 2.6 M NaOH. The organic media are dried over magnesium sulfate and the xylene solvent removed under vacuum stripping to yield 47 grams of final product. The product solidifies on cooling to room temperature.

EXAMPLE 2

(100 wt % active)

Into a 500 mL flask blanketed with nitrogen are charged 200 mL of isopropyl alcohol and 10 grams (0.04 mole) of Akzo's Duomeen C (N-coco-1,3-propylenediamine). To this, 3.4 grams (0.045 mole) of carbon disulfide is added at room temperature with stirring. The temperature is then slowly raised to reflux (82° C.) with the evolution of hydrogen sulfide, which is caught in a caustic trap. The temperature is maintained at 82° C. for 16 hours, yielding a clear yellow liquid. The product is then filtered and the isopropyl alcohol solvent removed under vacuum. The concentrated product is then redissolved in 150 mL of heptane and washed with 50 mL of 10 percent NaOH. The organic media are dried over magnesium sulfate and the heptane solvent is removed under vacuum stripping to yield 10.5 grams of final product. The product solidifies on cooling to room temperature.

EXAMPLE 3

(50 wt % active in SNO-100 base oil)

Into a one-liter flask blanketed with nitrogen are charged 146 grams of SNO-100 mineral base oil, 15 grams of isopropyl alcohol, and 121 grams (0.50 mole) of Akzo's Duomeen C (N-coco-1,3-propylenediamine). To this is added, with stirring and external cooling, 41 grams (0.5 mole) of carbon disulfide at a rate such that the exothermic reaction does not exceed 30° C. The temperature is then very slowly raised to 160° C. with the evolution of hydrogen sulfide, which is caught in a caustic trap under a nitrogen purge. The temperature is maintained at 160° C. for four hours, yielding a clear yellow liquid that solidifies on cooling.

EXAMPLE 4

(50 wt % active in SNO-100 base oil)

One hundred and fifty grams of the product of Example 3 is washed with 90 mL of 2.7 M aqueous NaOH. After separation of the product layer in a separatory funnel (20 mL of isopropyl alcohol may need to be added to break up any emulsion that may have formed), it is dried over anhydrous magnesium sulfate and filtered. If isopropyl alcohol is used, it is removed under vacuum stripping.

EXAMPLE 5

(40 wt % active in SNO-100 base oil)

Into a two-liter flask blanketed with nitrogen are charged 465 grams of SNO-100 mineral base oil, 36 grams of isopropyl alcohol, and 300 grams (0.85 mole) of Akzo's Duomeen O (N-oleyl-1,3-propylenediamine). To this is added, with stirring and external cooling, 64.8 grams (0.85 mole) of carbon disulfide at a rate such that the exothermic reaction does not exceed 30° C. The temperature is then very slowly raised to 155° C. with the evolution of hydrogen sulfide and isopropyl alcohol, which is caught in a caustic trap under a nitrogen purge. The temperature is maintained at 155° C. for three hours, yielding a clear yellow liquid that solidifies on cooling. At room temperature are added 150 mL of hexane, 120 mL of isopropyl alcohol, and 180 mL of 5.6 M NaOH. This mixture is vigorously stirred for ten minutes, then transferred to a separatory funnel to isolate the organic layer. The isolated organic layer is then dried over magnesium sulfate and filtered. To this solution are added 30 additional grams of SNO-100 and 24 grams of 2-ethylhexanol. The product is then placed under vacuum at 100° C. to remove residual isopropyl alcohol, yielding 754 grams of final product.

EXAMPLE 6

(100 wt % active)

Into a one-liter flask blanketed with nitrogen are charged 200 mL of toluene and 60 grams (0.18 mole) of Akzo's Duomeen O (N-oleyl-1,3-propylenediamine). To this is added, with stirring and external cooling, 15 grams (0.2 mole) of carbon disulfide in 50 mL of toluene at a rate such that the exothermic reaction does not exceed 30° C. The reaction media are then stirred for one hour at room temperature. The temperature is then slowly raised to reflux (110° C.) whereby hydrogen sulfide is evolved, which is caught in a caustic trap. The temperature is maintained at 110° C. for seven hours, yielding a clear yellow liquid. At room temperature, the reaction media are washed with 100 mL of aqueous 10 weight percent $NaHCO_3$. The organic media are dried over magnesium sulfate and the toluene solvent is removed under vacuum stripping to yield the final product. The product solidifies on cooling to room temperature.

EXAMPLE 7

(55 wt % active in SNO-100 base oil)

Into a 500 mL flask blanketed with nitrogen are charged 63 grams of SNO-100 mineral base oil, 5 grams of isopropyl alcohol, and 67 grams (0.2 mole) of Akzo's Duomeen O (N-oleyl-1,3-propylenediamine). To this is added, with stirring and external cooling, 16 grams (0.21 mole) of carbon disulfide at a rate such that the exothermic reaction does not exceed 30° C. The temperature is then very slowly raised to 70° C. and held there for 15 minutes with the evolution of hydrogen sulfide, which is caught in a caustic trap under a nitrogen purge. The temperature is then slowly raised to 160° C. and maintained there for two hours, yielding a clear yellow liquid. To these 160° C. solution media is added four grams of 2-ethylhexanol. The product is filtered through a bed of celite filter aid at room temperature and then slowly solidifies over a period of several hours.

EXAMPLE 8

(40 wt % active in SNO-100 base oil)

Into a two-liter flask blanketed with nitrogen are charged 465 grams of SNO-100 mineral base oil, 36 grams of isopropyl alcohol, and 300 grams (0.85 mole) of Akzo's Duomeen O (N-oleyl-1,3-propylenediamine). To this is added, with stirring and external cooling, 64.8 grams (0.85 mole) of carbon disulfide at a rate such that the exothermic reaction does not exceed 30° C. The temperature is then very slowly raised to 89° C. with the evolution of hydrogen sulfide, which is caught in a caustic trap under a nitrogen purge. Next, the isopropyl alcohol is refluxed for 1.5 hours and then distilled off. The temperature is then raised and maintained at 155° C. for four hours, yielding a clear yellow liquid that solidifies on cooling. At room temperature are added 150 mL of 10 weight percent aqueous NaOH and 120 mL of isopropyl alcohol. This mixture is vigorously stirred for fifteen minutes and then transferred to a separatory funnel to isolate the organic layer. The isolated organic layer is then dried over magnesium sulfate and filtered. To this solution is added 30 grams of 2-ethylhexanol. The product is then placed under vacuum at 100° C. to remove residual isopropyl alcohol, yielding 776 grams of final product. Another 85 grams of SNO-100 is added to reduce the active ingredient to 40 wt %.

EXAMPLE 9

(35 wt % active in SNO-100 base oil)

Into a three liter flask blanketed with nitrogen is charged 928 grams of SNO-100 mineral base oil, 60 grams of isopropyl alcohol and 500 grams (1.4 moles) of Akzo's Duomeen O (N-oleyl-1,3-propylenediamine). To this is added, with stirring and external cooling, 121 grams (1.6 moles) of carbon disulfide at a rate such that the exothermic reaction does not exceed 30° C. The temperature is then very slowly raised to 75–80° C. with the evolution of hydrogen sulfide, which is caught in a caustic trap under a nitrogen sparge. The temperature is then slowly raised to 155° C., distilling off the isopropyl alcohol. The temperature is maintained at 155° C. for 4.5 hours, yielding a clear yellow liquid that solidifies on cooling. At room temperature are added 150 mL of 5 weight percent aqueous NaOH and 135 mL of isopropyl alcohol. This mixture is vigorously stirred for thirty minutes and then transferred to a separatory funnel to isolate the organic layer. To this solution is added 26 grams of 2-ethylhexanol. The product is then placed under vacuum at 100° C. to remove residual isopropyl alcohol and water.

EXAMPLE 10

(75 wt % active in SNO-100 base oil)

Into a 250 mL flask blanketed with nitrogen are charged 40 mL of isopropyl alcohol and 80 grams (0.24 mole) of Tomah Products Inc.'s ether diamine DA-16 (isodecyloxypropyl-1,3-propylenediamine). To this is added, with stirring and external cooling, 18.2 grams (0.24 mole) of carbon disulfide at a rate such that the exothermic reaction does not exceed 30° C. The temperature is then very slowly raised to 75° to 80° C. with the evolution of hydrogen sulfide, which is caught in a caustic trap under a nitrogen sparge. The temperature is then slowly raised to 145° C., distilling off the isopropyl alcohol. The temperature is maintained at 145° C. for one hour, followed by the addition of 29 grams of SNO-100 mineral base oil, yielding a clear yellow liquid that remains a liquid on cooling. At room temperature is added 100 mL of hexane and 50 mL of 5 weight percent aqueous NaOH. This mixture is vigorously stirred for fifteen minutes and then transferred to a separatory funnel to isolate the organic layer (after standing for 30 to 45 minutes). The product is then placed under vacuum (100 mm Hg) at 100° C. to remove residual isopropyl alcohol and water. The final product isolated weighed 110 grams.

EXAMPLE 11

(100 wt % active)

Into a 500 mL flask blanketed with nitrogen are charged 200 mL of isopropyl alcohol and 10 grams (0.069 mole) of N,N'-diisopropylethylenediamine. To this is added, at room temperature with stirring, 5.3 grams (0.07 mole) of carbon disulfide. The temperature is then slowly raised to reflux (82° C.) with the evolution of hydrogen sulfide, which is caught in a caustic trap. The temperature is maintained at 82° C. for 16 hours, yielding a clear yellow liquid. The product is then filtered and the isopropyl alcohol solvent is removed under vacuum. The concentrated product is then redissolved in 150 mL of heptane and washed with 50 mL of 10 percent NaOH. The organic media are dried over magnesium sulfate and the heptane solvent removed under vacuum stripping to yield 10.5 grams of an oily product that solidifies on cooling to room temperature.

EXAMPLE 12

(40 wt % active in SNO-100 base oil)

Into a two-liter flask blanketed with nitrogen are charged 588 grams of SNO-100 mineral base oil, 40 grams of isopropyl alcohol, and 375 grams (0.1 mole) of Akzo's Duomeen O (N-oleyl-1,3-propylenediamine). To this is added, with stirring and external cooling, 83.6 grams (0.11 mole) of carbon disulfide at a rate such that the exothermic reaction does not exceed 30° C. The temperature is then very slowly raised to 75° to 80° C. with the evolution of hydrogen sulfide, which is caught in a caustic trap under a nitrogen sparge. The temperature is then slowly raised to 155° C., distilling off the isopropyl alcohol, maintained at that temperature for four hours, and lowered to room temperature, whereupon 150 mL of 5 weight percent aqueous NaOH and 200 mL of isopropyl alcohol are added. This mixture is vigorously stirred for fifteen minutes and then transferred to a separatory funnel to isolate the organic layer (after standing for 30 to 45 minutes). The product is then placed under vacuum (100 mm Hg) at 100° C. to remove residual isopropyl alcohol and water. To this solution is added 35 grams of 2-ethylhexanol. The final product isolated weighed 1,004 grams.

Four-Ball AntiWear Testing

The antiwear properties of the novel reaction product in a fully formulated lubricating oil were determined in the Four-Ball Wear Test under the ASTM D 4172 test conditions. The fully formulated lubricating oils tested also contained 1 weight percent cumene hydroperoxide to help simulate the environment within a running engine. The additives were tested for effectiveness in two motor oil formulations (See description in Table 2) and compared to identical formulations with and without any zinc dialkyldithiophosphate. In Table 3, the numerical value of the test results (Average Wear Scar Diameter, mm) decreases with an increase in effectiveness.

TABLE 2

SAE 10W-30 Motor Oil Formulations

| Component | Formulation A (wt %) | Formulation B (wt %) |
|---|---|---|
| Solvent Neutral 100 | Balance | Balance |
| Solvent Neutral 150 | 60 | 60 |
| Succinimide Dispersant | 7.5 | 7.5 |
| Overbased Calcium Phenate | 2.0 | — |

TABLE 2-continued

SAE 10W-30 Motor Oil Formulations

| Component | Formulation A (wt %) | Formulation B (wt %) |
|---|---|---|
| Detergent | | |
| Overbased Calcium Sulfonate | — | 2.0 |
| Detergent | | |
| Corrosion/Rust Inhibitor | 0.6 | 0.6 |
| Antioxidant | 0.5 | 0.5 |
| Pour Point Depressant | 0.1 | 0.1 |
| OCP VI Improver | 5.5 | 5.5 |
| Antiwear Additive[1] | 1.0 | 1.0 |

[1]In the case of No antiwear additive in Table 3, solvent neutral 100 is put in its plaee at 1.0 weight percent. The formulation is treated so that 1 weight percent Antiwear additive is based upon 100 percent active material.

TABLE 3

Falex Four-Ball Wear Results

| Compound | Formulation | Wear Scar Diameter, mm |
|---|---|---|
| No antiwear additive | A | 0.93 |
| Zinc dialkyldithiophosphate | A | 0.46 |
| Example 1 | A | 0.48 |
| Example 2 | A | 0.45 |
| Example 5 | A | 0.51 |
| Example 6 | A | 0.42 |
| Example 7 | A | 0.62 |
| Example 8 | A | 0.44 |
| Example 9 | A | 0.52 |
| Example 10 | A | 0.54 |
| Example 11 | A | 0.51 |
| Example 12 | A | 0.70 |
| No antiwear additive | B | 0.98 |
| Zinc dialkyldithiophosphate | B | 0.53 |
| Example 1 | B | 0.48 |
| Example 2 | B | 0.41 |
| Example 3 | B | 0.51 |
| Example 4 | B | 0.53 |
| Example 6 | B | 0.46 |
| Example 7 | B | 0.41 |
| Example 8 | B | 0.41 |
| Example 9 | B | 0.52 |
| Example 10 | B | 0.51 |
| Example 11 | B | 0.52 |

Cameron-Plint TE77 High Frequency Friction Machine Antiwear Testing

The antiwear properties of the additives of this invention in a fully formulated lubricating oil were determined in the Four-Ball Wear Test under the ASTM D 4172 test conditions. The specimen parts (6 mm diameter AISI 52100 steel ball of 800±20 kg/mm$^2$ hardness and hardened ground NSOH B01 gauge plate of RC 60/0.4 micron) were rinsed and then sonicated for 15 minutes with technical grade hexanes. This procedure was repeated with isopropyl alcohol. The specimens were dried with nitrogen and set into the TE77. The oil bath was filled with 10 mL of sample. The test was run at a 30 Hertz Frequency, 100 Newton Load, 2.35 mm Amplitude. The test started with the specimens and oil at room temperature. Immediately, the temperature was ramped over 15 minutes to 50° C., where it dwelled for 15 minutes. The temperature was ramped over 15 minutes to 100° C., where it dwelled at 100° C. for 45 minutes. A third temperature ramp over 15 minutes to 150° C. was followed by a final dwell at 150° C. for 15 minutes. The total length of the test was two hours. At the end of the test, the wear scar diameter on the 6 mm ball was measured using a Leica Stereo Zoom 6® Stereomicroscope and a Mitutoyo 164 series Digimatic Head. The fully formulated lubricating oils tested contained 1 weight percent cumene hydroperoxide to help simulate the environment within a running engine. The additives were tested for effectiveness in two motor oil formulations (See description in Table 2) and compared to identical formulations with and without any zinc dialkyldithiophosphate. In Table 4 the numerical value of the test results (Wear Scar Diameter, mm) decreases with an increase in effectiveness.

TABLE 4

Cameron-Plint High Frequency Friction Machine (Model TE77) Wear Results

| Compound | Formulation | Wear Scar Diameter, mm |
|---|---|---|
| No antiwear additive | A | 0.66 |
| Zinc dialkyldithiophosphate | A | 0.46 |
| Example 2 | A | 0.44 |
| Example 6 | A | 0.37 |
| Example 11 | A | 0.51 |
| Example 12 | A | 0.55 |
| No antiwear additive | B | 0.67 |
| Zinc dialkyldithiophosphate | B | 0.54 |
| Example 2 | B | 0.39 |
| Example 7 | B | 0.57 |
| Example 8 | B | 0.57 |
| Example 11 | B | 0.57 |

Examples of Use as Antiwear Additive in Mixtures with ZDDP

The additives of the present invention can, if desired, also be used in combination with ZDDP antiwear additives. The four ball and Cameron-Plint data, run as described above, shown below in Tables 5 and 6, respectively, confirm the effectiveness of the additives of the present invention in combination with ZDDP. Formulations A and B were used as described above, except that the antiwear additive system was a combination of the antiwear additive of the present invention and ZDDP, resulting in a 1 weight percent total antiwear additive combination in each formulation.

TABLE 5

Falex Four-Ball Wear Results of Additives in Mixtures with ZDDP

| Compound | Weight % | ZDDP wt % | Formulation | Wear Scar Diameter, mm |
|---|---|---|---|---|
| Example 1 | 0.25 | 0.75 | A | 0.55 |
| Example 1 | 0.50 | 0.50 | A | 0.52 |
| Example 1 | 0.75 | 0.25 | A | 0.47 |
| Example 1 | 0.25 | 0.75 | B | 0.48 |
| Example 1 | 0.50 | 0.50 | B | 0.52 |
| Example 1 | 0.75 | 0.25 | B | 0.38 |
| Example 7 | 0.25 | 0.75 | A | 0.53 |
| Example 7 | 0.50 | 0.50 | A | 0.55 |
| Example 7 | 0.75 | 0.25 | A | 0.58 |
| Example 7 | 0.25 | 0.75 | B | 0.53 |
| Example 7 | 0.50 | 0.50 | B | 0.68 |
| Example 7 | 0.75 | 0.25 | B | 0.50 |
| Example 11 | 0.25 | 0.75 | A | 0.55 |
| Example 11 | 0.50 | 0.50 | A | 0.61 |
| Example 11 | 0.75 | 0.25 | A | 0.51 |
| Example 11 | 0.25 | 0.75 | B | 0.55 |

TABLE 5-continued

Falex Four-Ball Wear Results of Additives in Mixtures with ZDDP

| Compound | Weight % | ZDDP wt % | Formulation | Wear Scar Diameter, mm |
|---|---|---|---|---|
| Example 11 | 0.50 | 0.50 | B | 0.62 |
| Example 11 | 0.75 | 0.25 | B | 0.54 |

TABLE 6

Cameron-Plint High Frequency Friction Machine Wear (Model TE77) Results of Additives in Mixtures with ZDDP

| Compound | Weight % | ZDDP wt % | Formulation | Wear Scar Diameter, mm |
|---|---|---|---|---|
| Example 1 | 0.25 | 0.75 | A | 0.53 |
| Example 1 | 0.50 | 0.50 | A | 0.55 |
| Example 1 | 0.75 | 0.25 | A | 0.39 |
| Example 1 | 0.25 | 0.75 | B | 0.57 |
| Example 1 | 0.50 | 0.50 | B | 0.52 |
| Example 1 | 0.75 | 0.25 | B | 0.36 |
| Example 7 | 0.25 | 0.75 | A | 0.48 |
| Example 7 | 0.50 | 0.50 | A | 0.66 |
| Example 7 | 0.75 | 0.25 | A | 0.40 |
| Example 7 | 0.25 | 0.75 | B | 0.58 |
| Example 7 | 0.50 | 0.50 | B | 0.59 |
| Example 7 | 0.75 | 0.25 | B | 0.53 |
| Example 11 | 0.25 | 0.75 | A | 0.56 |
| Example 11 | 0.50 | 0.50 | A | 0.48 |
| Example 11 | 0.75 | 0.25 | A | 0.42 |
| Example 11 | 0.25 | 0.75 | B | 0.61 |
| Example 11 | 0.50 | 0.50 | B | 0.58 |
| Example 11 | 0.75 | 0.25 | B | 0.47 |

Four-Ball Extreme Pressure Testing

The extreme pressure (EP) properties of the additives of this invention in a lubricating oil were determined in the Four-Ball Weld Test under the ASTM D 2783 test conditions. The additives were blended into an ISO 46 Grade Group II base oil (Chevron RLOP 240 R) at the weight percents cited in Table 7. The higher the Load Wear Index and the higher the Weld Point, the better the result.

TABLE 7

Four-Ball Extreme Pressure Testing Results

| Compounds | wt % | Oil | Weld Point (Kg) | Load Wear Index |
|---|---|---|---|---|
| No antiwear additive | 0 | ISO 46 | 100 | 16.8 |
| Example 11 | 1 | ISO 46 | 160 | 21.6 |
| Example 11 | 2 | ISO 46 | 160 | 33.1 |
| Example 13 | 1 | ISO 46 | 120 | 32.1 |
| Example 13 | 2 | ISO 46 | 160 | 27.4 |

In view of the many changes and modifications that can be made without departing from principles underlying the invention, reference should be made to the appended claims for an understanding of the scope of the protection to be afforded the invention.

What is claimed is:

1. A composition comprising:

(A) a lubricating oil, and (B) at least one cyclic thiourea selected from the group consisting of:

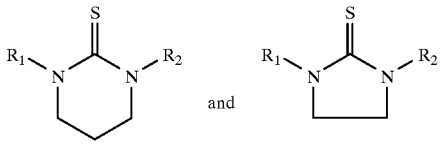

wherein $R_1$ and $R_2$ are independently selected from the group consisting of alkyl, functionalized alkyl, and hydrogen.

2. The composition of claim 1 wherein the cyclic thiourea is

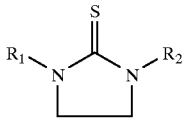

3. The composition of claim 2 wherein $R_1$ is hydrogen and $R_2$ is an alkyl chain of from 12 to 18 carbon atoms.

4. The composition of claim 2 wherein $R_1$ is hydrogen and $R_2$ is a functionalized alkyl chain of from 12 to 18 linear carbon atoms containing at least one ether oxygen within the chain.

5. A composition comprising:

(A) a lubricating oil, and (B) at least one cyclic thiourea of the structure:

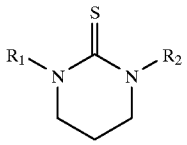

wherein $R_1$ and $R_2$ are independently selected from the group consisting of alkyl, functionalized alkyl, and hydrogen.

6. The composition of claim 5 wherein the cyclic thiourea is derived from:

octyl/decyloxypropyl-1,3-diaminopropane;

isodecyloxypropyl-1,3-diaminopropane;

isododecyloxypropyl-1,3-diaminopropane;

dodecyl/tetradecyloxypropyl-1,3-diaminopropane;

isotridecyloxypropyl-1,3-diaminopropane;

tetradecyloxypropyl-1,3-diaminopropane;

N-coco-1,3-diaminopropanes;

N-tallow-1,3-diaminopropanes; or

N-oleyl-1,3-diaminopropane.

7. The composition of claim 5 wherein the cyclic thiourea is present in a concentration in the range of from about 0.01 to about 10 weight percent.

8. The composition of claim 5 further comprising at least one additive selected from the group consisting of dispersants, detergents, corrosion/rust inhibitors, zinc dialkyldithiophosphates, VI improvers, and pour point depressants.

9. The composition of claim 5 further comprising zinc dialkyldithiophosphate.

10. The composition of claim 5 wherein the alkyl is a straight chain alkyl, a branched chain alkyl, an alkyl containing a cyclic structure, a fully saturated hydrocarbon (alkyl) chain, or a partially unsaturated hydrocarbon (alkyl) chain.

11. A composition comprising:

(A) a lubricating oil, and (B) at least one cyclic thiourea of the structure:

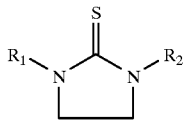

wherein $R_1$ and $R_2$ are independently selected from the group consisting of alkyl and functionalized alkyl.

12. The composition of claim 11 further comprising at least one additive selected from the group consisting of dispersants, detergents, corrosion/rust inhibitors, zinc dialkyldithiophosphates, VI improvers, and pour point depressants.

13. The composition of claim 11 further comprising zinc dialkyldithiophosphate.

14. The composition of claim 11 wherein the alkyl is a straight chain alkyl, a branched chain alkyl, an alkyl containing a cyclic structure, a fully saturated hydrocarbon (alkyl) chain, or a partially unsaturated hydrocarbon (alkyl) chain.

* * * * *